US008491505B2

(12) United States Patent
Yang

(10) Patent No.: US 8,491,505 B2
(45) Date of Patent: Jul. 23, 2013

(54) EYES-MASSAGE DEVICE

(76) Inventor: Cheng-Chuan Yang, Taichung (TW)

( * ) Notice: Subject to any disclaimer, the term of this patent is extended or adjusted under 35 U.S.C. 154(b) by 337 days.

(21) Appl. No.: 13/044,508

(22) Filed: Mar. 9, 2011

(65) Prior Publication Data

US 2011/0251532 A1 Oct. 13, 2011

(30) Foreign Application Priority Data

Apr. 7, 2010 (TW) ..... 99206107 U

(51) Int. Cl.
*A61H 1/00* (2006.01)

(52) U.S. Cl.
USPC ..... 601/15; 601/37; 601/46

(58) Field of Classification Search
USPC ..... 601/13, 15, 16, 37, 46, 49, 55, 56, 601/57, 58, 61, 64–67, 69, 70, 71, 75, 78, 601/79, 84, 85–90, 93, 96, 133, 134, 136, 601/138, 143, 144, 147, 148; 607/96–109; 2/10, 2/15, 12, 425, 9; 165/67, 80.2, 80.3, 185; 361/697
See application file for complete search history.

(56) References Cited

U.S. PATENT DOCUMENTS 2,237,971 A * 4/1941 Padelford ..... 607/109
3,096,106 A * 7/1963 Wanner ..... 403/197
3,140,390 A * 7/1964 Smith et al. ..... 607/109
3,195,539 A * 7/1965 Hyman ..... 604/23
3,541,608 A * 11/1970 Otwell ..... 2/15
4,243,041 A * 1/1981 Paul ..... 607/109
4,574,787 A * 3/1986 Jacobs ..... 601/148
4,603,996 A * 8/1986 Chen ..... 403/7
4,614,189 A * 9/1986 MacKenzie ..... 607/109
4,915,108 A * 4/1990 Sun ..... 607/96
4,920,956 A * 5/1990 Yamauchi ..... 601/15
5,074,300 A * 12/1991 Murphy ..... 607/108
5,385,323 A * 1/1995 Garelick ..... 248/161
5,746,702 A * 5/1998 Gelfgat et al. ..... 601/15
5,902,256 A * 5/1999 Benaron ..... 601/15
6,125,636 A * 10/2000 Taylor et al. ..... 62/3.5
6,155,995 A * 12/2000 Lin ..... 601/15
6,404,633 B1 * 6/2002 Hsu ..... 361/703
7,637,878 B2 * 12/2009 Lin ..... 601/70
8,109,964 B2 * 2/2012 Payne ..... 606/204.25
8,142,373 B1 * 3/2012 Riles ..... 601/71
2001/0007952 A1 * 7/2001 Shimizu ..... 607/109
2001/0039442 A1 * 11/2001 Gorge et al. ..... 607/109
2002/0068886 A1 * 6/2002 Lin ..... 601/15
2003/0056281 A1 * 3/2003 Hasegawa ..... 2/428
2004/0059400 A1 * 3/2004 Lin ..... 607/109
2004/0165355 A1 * 8/2004 Chen ..... 361/709
2005/0222654 A1 * 10/2005 Brown ..... 607/109
2005/0256433 A1 * 11/2005 Lin ..... 601/70
2005/0269060 A1 * 12/2005 Ku et al. ..... 165/80.3
2006/0116615 A1 * 6/2006 Zheng et al. ..... 601/84
2006/0117450 A1 * 6/2006 Matsumoto ..... 2/10
2009/0027858 A1 * 1/2009 Lai et al. ..... 361/709
2010/0004569 A1 * 1/2010 Kim et al. ..... 601/17
2010/0193158 A1 * 8/2010 Lin ..... 165/67
2010/0258272 A1 * 10/2010 Li et al. ..... 165/80.3

* cited by examiner

*Primary Examiner* — Justine Yu
*Assistant Examiner* — Eric Liu

(57) ABSTRACT

An eyes-massage device includes a head strap and a hot or cold eyes-compressing mechanism mounted on the head strap. The hot or cold eyes-compressing mechanism includes a compressing bag, a transmitter, and a semiconductor. The compressing bag has a connecting hole defined therein for receiving the transmitter. The semiconductor is mounted on the transmitter. The compressing bag is heated or cooled by the semiconductor to control a temperature of the compressing bag for adapting to provide a heat or cool compressing effect on eyes.

11 Claims, 2 Drawing Sheets

EYES-MASSAGE DEVICE

BACKGROUND OF THE INVENTION

1. Field of the Invention

The present invention relates to a massage deice device, and more particularly to a massage device for applying hot or cold compression on eyes.

2. Description of Related Art

A conventional massage device for eyes includes a casing having a receiving space defined therein. The receiving space has two through holes defined therein and passing therethrough for corresponding to two eyes of human body. A strap has two ends respectively connecting with two sides of the casing for surrounding a human head. Two magnetic mechanisms are received in the receiving space. The two magnetic mechanisms respectively extend into the two through holes for compressing the eyes. A power source is disposed in the receiving space. An eccentric cam mechanism is mounted in the receiving space and connecting with the two magnetic mechanisms. The eccentric cam mechanism is driven by the power source for proving vibration to massage the eyes.

However, eye is a weak organ of human body. The vibration massage on the eyes is not suitable for everybody. Especially the muscles around the eyes are not tough and the vibration massage causes strong stimulus, such that the conventional massage device possibly causes some damages on the eyes.

The present invention has arisen to mitigate and/or obviate the disadvantages of the conventional massage device.

SUMMARY OF THE INVENTION

To achieve the objective, an eyes-massage device in accordance with the present invention comprises a head strap and a hot or cold eyes-compressing mechanism mounted on the head strap. The head strap is an elastic belt and is elastically adjustable. The hot or cold eyes-compressing mechanism includes a compressing bag, a transmitter, a semiconductor-based thermoelectric cooling module, a diaphragm and a transmission member.

The compressing bag can be integrally molded with silica gel. The compressing bag also can be composed of an upper casing and a lower casing liquid-tightly buckled to each other. Both of the upper casing and the lower casing are made of silica material. The compressing bag has an inlet disposed thereon. A blocker is mounted in the inlet. The compressing bag has a connecting hole defined therein for receiving the transmitter. The thermoelectric cooling module is mounted on the transmitter.

The diaphragm has an inner side assembled with the compressing bag and an outer side assembled with the transmission member. The diaphragm has an orifice defined therein and passing therethrough for corresponding to the thermoelectric cooling module. The transmission member has a plurality of fins extending therefrom and received in the orifice for contacting with the thermoelectric cooling module. The transmission member and the diaphragm are fixed with screws.

The hot or cold eyes-compressing mechanism includes a fixing supporter disposed between the compressing bag and the diaphragm. The fixing supporter has an opening defined therein for receiving the thermoelectric cooling module and assembling with the transmitter. The fixing supporter is detachable from the diaphragm, such that the thermoelectric cooling module and the transmitter are fixed in the connecting hole in the compressing bag. The diaphragm has a fixing ring mounted thereon for detachably assembling with fixing supporter. The fixing ring has a plurality of ribs formed on an inner periphery thereof. The fixing supporter has a plurality of slots defined in an outer periphery thereof for corresponding to the ribs of the fixing ring such that the diaphragm is detachable from the fixing supporter.

The hot or cold eyes-compress mechanism includes a cooling assembly mounted on the transmission member. The cooling assembly has a rack mounted around the fins and a fan mounted on the rack for dissipating the temperature of the fins.

The compressing bag has two first vibration motors mounted thereon and two massage sheets respectively mounted on the two first vibration motors for adapting to correspond to the eyes. The massage sheets are made of silica gel, such that the message sheets and the first vibration motors are provided for softly messaging the eyes.

The head strap has a first belt having two ends respectively connecting with two sides of the hot or cold eyes-compress mechanism. The two ends of the first belt are detachable from the hot or cold eyes-compress mechanism. The head strap 1 has two second belts connecting with the first belt and disposed above the hot or cold eyes-compress mechanism. The head strap 1 has a plurality of second vibration motors mounted thereon and a plurality of vibrational massage sheets respectively mounted on the second vibration motors. Each vibrational massage sheet is made of silica gel.

Wherein, the compressing bag is heated or cooled by the thermoelectric cooling module to control a temperature of the transmitter. The transmitter controls the temperature of the compressing bag for adapting to provide a heat compressing effect or a cool compressing effect on eyes.

Further benefits and advantages of the present invention will become apparent after a careful reading of the detailed description with appropriate reference to the accompanying drawings.

DETAILED DESCRIPTION OF THE INVENTION

Figure 1:
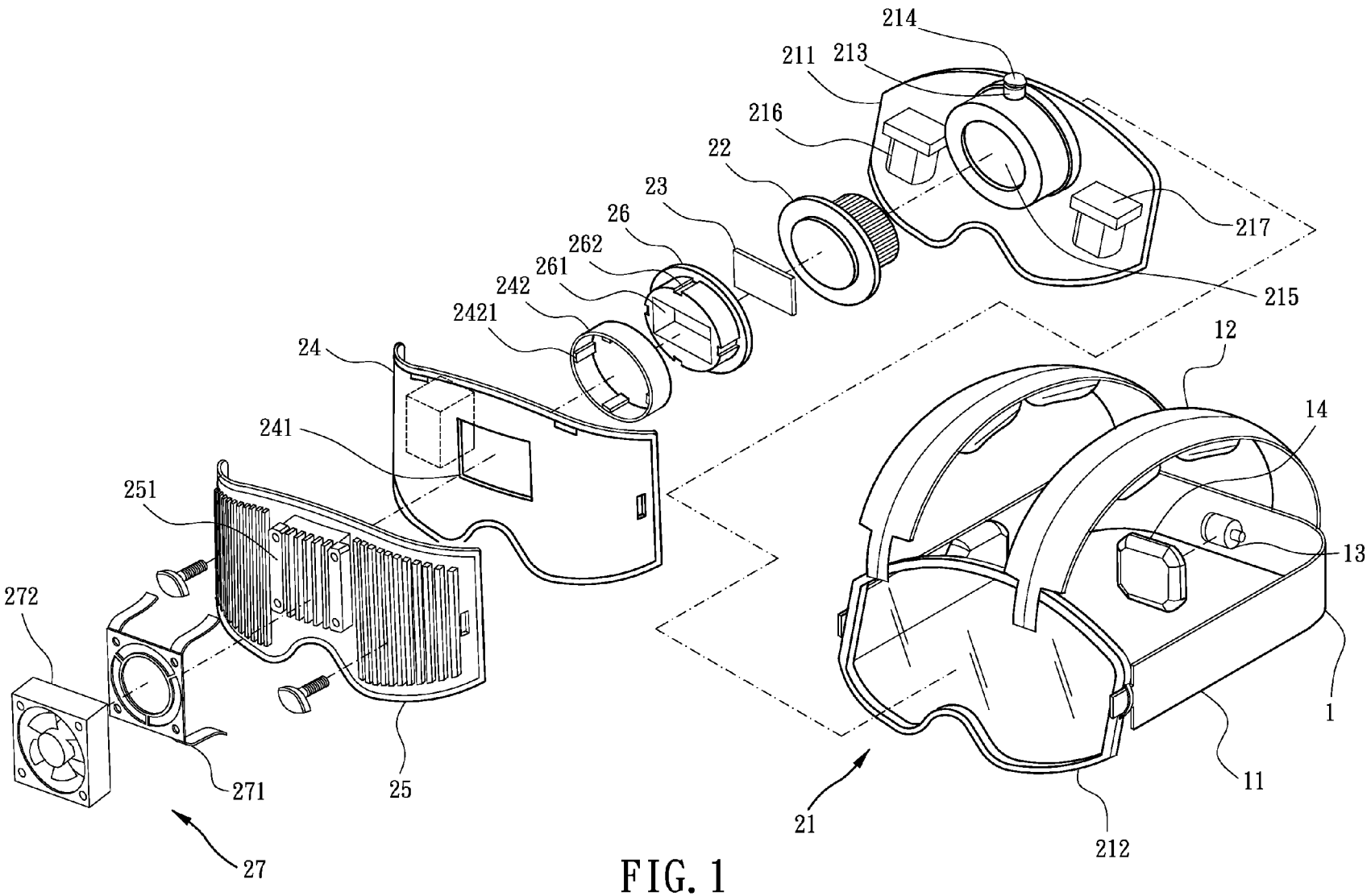
FIG. 1 is an exploded perspective view of an eyes-massage device in accordance with the present invention.
Figure 2:
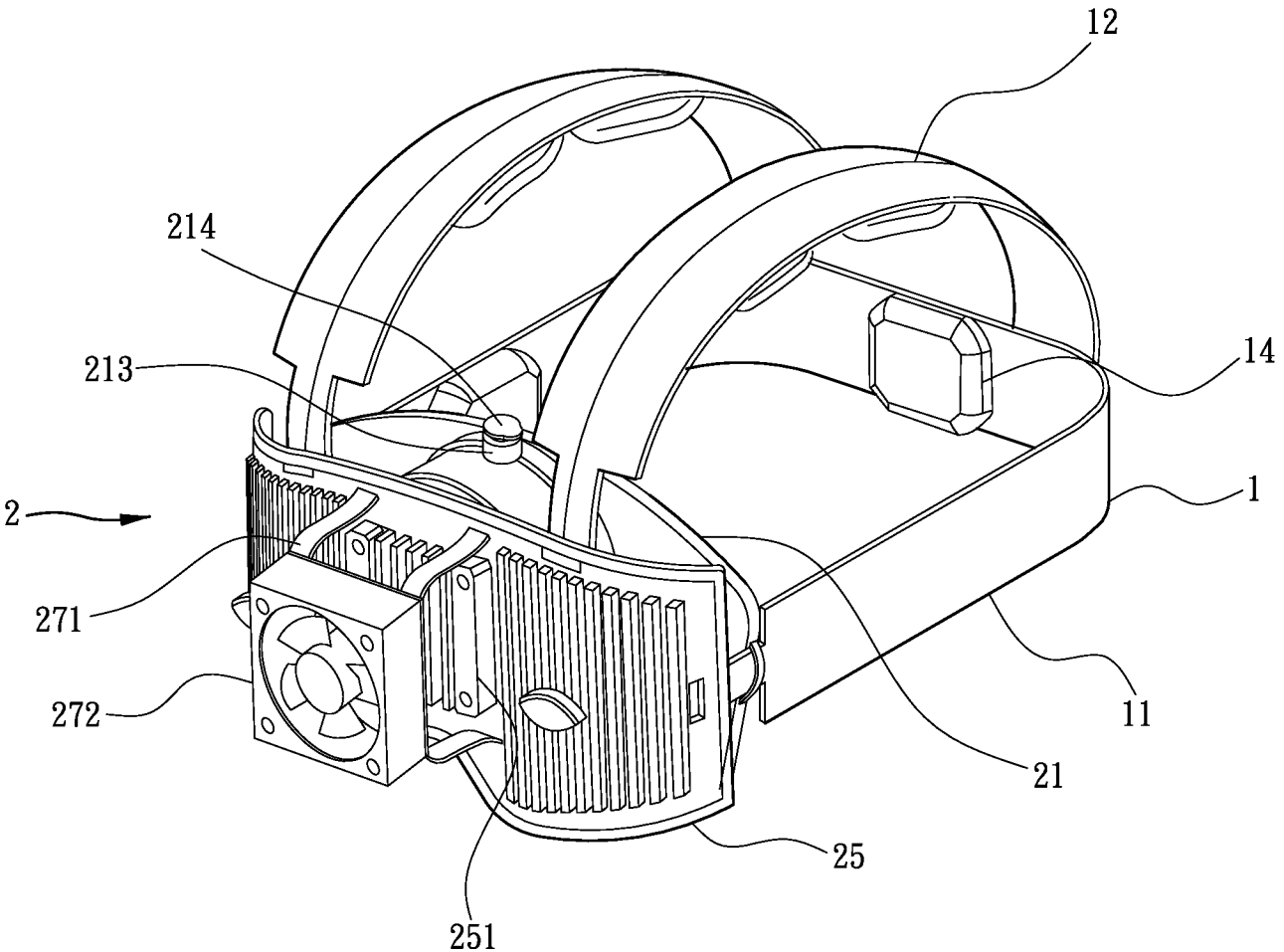
FIG. 2 is an assembled perspective view of the eyes-massage device in accordance with the present invention.

Referring to the drawings and initially to FIGS. 1-2, an eyes-massage device in accordance with the present invention comprises a head strap 1 and a hot or cold eyes-compressing mechanism 2 mounted on the head strap. The head strap 1 is an elastic belt and is elastically adjustable. The hot or cold eyes-compressing mechanism 2 includes a compressing bag 21, a transmitter 22, a semiconductor-based thermoelectric cooling module 23, a diaphragm 24 and a transmission member 25.

The compressing bag 21 is provided for contacting with human eyes. The compressing bag 21 can be integrally molded with silica gel. The compressing bag 21 also can be composed of an upper casing 211 and a lower casing 212 liquid-tightly buckled to each other. Both of the upper casing 211 and the lower casing 212 are made of silica material. The compressing bag 21 has an inlet 213 disposed thereon. A blocker 214 is mounted in the inlet 213. The compressing bag 21 has a connecting hole 215 defined therein for receiving the transmitter 22.

The thermoelectric cooling module 23 is mounted on the transmitter 22. The characteristics of the thermoelectric cooling module 23 are: when an input power is direct current 12 voltage, a positive pole and a native pole of the thermoelectric cooling module 23 are electrically connected with the input power for increasing temperature, and the positive pole and the negative pole of the thermoelectric cooling module 23 are reversely electrically connected with the input power for decreasing temperature.

The diaphragm 24 has an inner side assembled with the compressing bag 21 and an outer side assembled with the transmission member 25. The diaphragm 24 has an orifice 241 defined therein and passing therethrough for corresponding to the thermoelectric cooling module 23. The transmission member 25 has a plurality of fins 251 extending therefrom and received in the orifice 241 for contacting with the thermoelectric cooling module 23. The transmission member 25 and the diaphragm 24 are fixed with screws.

The hot or cold eyes-compressing mechanism 2 includes a fixing supporter 26 disposed between the compressing bag 21 and the diaphragm 24. The fixing supporter 26 has an opening 261 defined therein for receiving the thermoelectric cooling module 23 and assembling with the transmitter 22. The fixing supporter 26 is detachable from the diaphragm 24, such that the thermoelectric cooling module 23 and the transmitter 22 are fixed in the connecting hole 215 in the compressing bag 21. The diaphragm 24 has a fixing ring 242 mounted thereon for detachably assembling with fixing supporter 26. The fixing ring 242 has a plurality of ribs 2421 formed on an inner periphery thereof. The fixing supporter 26 has a plurality of slots 262 defined in an outer periphery thereof for corresponding to the ribs 2421 of the fixing ring 242 such that the diaphragm 24 is detachable from the fixing supporter 26.

The hot or cold eyes-compress mechanism includes a cooling assembly 27 mounted on the transmission member 25. The cooling assembly 27 has a rack 271 mounted around the fins 251 and a fan 272 mounted on the rack 271 for dissipating the temperature of the fins 251.

The compressing bag 21 has two first vibration motors 216 mounted thereon and two massage sheets 217 respectively mounted on the two first vibration motors 216 for adapting to correspond to the eyes. The massage sheets 217 are made of silica gel, such that the message sheets 217 and the first vibration motors 216 are provided for softly messaging the eyes.

The head strap 1 has a first belt 11 having two ends respectively connecting with two sides of the hot or cold eyes-compress mechanism 2. The two ends of the first belt 11 are detachable from the hot or cold eyes-compress mechanism 2. The head strap 1 has two second belts 12 connecting with the first belt 11 and disposed above the hot or cold eyes-compress mechanism 2. The head strap 1 has a plurality of second vibration motors 13 mounted thereon and a plurality of vibrational massage sheets 14 respectively mounted on the second vibration motors 13. Each vibrational massage sheet 14 is made of silica gel.

Wherein, the compressing bag 21 is heated or cooled by the thermoelectric cooling module 23 to control a temperature of the transmitter 22. The transmitter 22 controls the temperature of the compressing bag 21 for adapting to provide a heat compressing effect or a cool compressing effect on eyes.

Although the invention has been explained in relation to its preferred embodiment, it is to be understood that many other possible modifications and variations can be made without departing from the spirit and scope of the invention as hereinafter claimed.

What is claimed is:

1. An eyes-massage device comprising a head strap and a hot or cold eyes-compressing mechanism mounted on the head strap, wherein the eyes-compressing mechanism includes:

a transmitter;

a compressing bag having a connecting hole defined therein for receiving the transmitter;

a semiconductor-based thermoelectric cooling module mounted on the transmitter; wherein the compressing bag is heated or cooled by the semiconductor-based thermoelectric cooling module to control a temperature of the compressing bag for adapting to provide a heat or cool compressing effect on eyes;

a diaphragm assembled with the compressing bag and having an orifice defined therein and passing therethrough for corresponding to the semiconductor-based thermoelectric cooling module; and a transmission member assembled with the diaphragm and having a plurality of fins extending therefrom and contacting with the semiconductor-based thermoelectric cooling module;

wherein the hot or cold eyes-compress mechanism further includes a fixing supporter disposed between the compressing bag and the diaphragm, the fixing supporter having an opening defined therein for receiving the semiconductor-based thermoelectric cooling module and assembling with the transmitter, the fixing supporter being detachable from the diaphragm, such that the semiconductor-based thermoelectric cooling module and the transmitter are fixed in the connecting hole in the compressing bag.

2. The eyes-massage device as claimed in claim 1, wherein the compressing bag has two vibration motors mounted thereon and two massage sheets respectively mounted on the two vibration motors for adapting to correspond to the eyes, the massage sheets being made of silica gel.

3. The eyes-massage device as claimed in claim 1, wherein the head strap has a first belt having two ends respectively connecting with two sides of the hot or cold eyes-compress mechanism, the two ends of the first belt being detachable from the hot or cold eyes-compress mechanism, the head strap having two second belts connecting with the first belt and disposed above the hot or cold eyes-compress mechanism.

4. The eyes-massage device as claimed in claim 1 wherein the head strap is an elastic belt and is elastically adjustable.

5. The eyes-massage device as claimed in claim 1 wherein the compressing bag is integrally molded with silica gel.

6. The eyes-massage device as claimed in claim 1 wherein the compressing bag is composed of an upper casing and a lower casing liquid-tightly buckled to each other, the upper casing and the lower casing being made of silica material.

7. The eyes-massage device as claimed in claim 1 wherein the compressing bag has an inlet disposed thereon, a blocker mounted in the inlet.

8. The eyes-massage device as claimed in claim 1 wherein the transmission member and the diaphragm are fixed with screws.

9. The eyes-massage device as claimed in claim 1 wherein the diaphragm has a fixing ring mounted thereon for detachably assembling with fixing supporter, the fixing ring having a plurality of ribs formed on an inner periphery thereof, the fixing supporter having a plurality of slots defined in an outer periphery thereof for corresponding to the ribs of the fixing ring such that the diaphragm is detachable from the fixing supporter.

10. The eyes-massage device as claimed in claim 1 wherein the head strap has a plurality of vibration motors mounted thereon and a plurality of vibrational massage sheets respectively mounted on the vibration motors, each vibrational massage sheet being made of silica gel.

11. The eyes-massage device as claimed in claim 1 wherein the hot or cold eyes-compress mechanism includes a cooling assembly mounted on the transmission member, the cooling assembly having a rack mounted around the fins and a fan mounted on the rack for dissipating the temperature of the fins.

* * * * *